United States Patent [19]

Hayashi

[11] Patent Number: 4,920,035

[45] Date of Patent: Apr. 24, 1990

[54] IMAGE FORMING METHOD

[75] Inventor: Katsumi Hayashi, Kanagawa, Japan

[73] Assignee: Fuji Photo Film Co., Ltd., Kanagawa, Japan

[21] Appl. No.: 109,379

[22] Filed: Oct. 19, 1987

[30] Foreign Application Priority Data

Oct. 17, 1986 [JP] Japan ..... 61-247242
Oct. 20, 1986 [JP] Japan ..... 61-249305

[51] Int. Cl.[5] ..... G03C 1/06

[52] U.S. Cl. ..... 430/267; 430/265; 430/608; 430/949

[58] Field of Search ..... 430/265, 267, 264, 949, 430/608

[56] References Cited

U.S. PATENT DOCUMENTS 3,260,598 7/1966 Yutzy et al. .
3,379,528 4/1968 Henn et al. ..... 430/608
4,269,929 5/1981 Nothnagle ..... 430/264
4,385,108 5/1983 Takagi et al. ..... 430/264
4,740,363 4/1988 Hirai et al. ..... 430/203 X
4,740,445 4/1988 Hirai et al. ..... 430/203

OTHER PUBLICATIONS

Abstract (Barnett) of Ser. No. 824,307 filed 05/13/69, Published in 867 O.G. 749 on 10/21/69.

*Primary Examiner*—Roland E. Martin
*Attorney, Agent, or Firm*—Sughrue, Mion, Zinn, Macpeak & Seas

[57] ABSTRACT

An image is formed by imagewise exposing a silver halide light-sensitive material comprising at least a silver halide and a contrast enhancing agent, and producing the exposed material with a developer solution or aqueous activator solution in the presence of a substantially water-insoluble metal compound such as zinc hydroxide and a complexing compound such as guanidine picolinate.

21 Claims, No Drawings

IMAGE FORMING METHOD

BACKGROUND OF THE INVENTION

This invention relates to image formation using a photographic silver halide light-sensitive material. More particularly, it relates to a method for forming an image in a plate making photographic silver halide light-sensitive material whereby a superhigh contrast image suitable for printing process photography can be consistently produced.

The photographic plate making procedure requires an image forming system capable of providing superhigh contrast photographic characteristics to achieve satisfactory reproduction of a continuous tone image by a halftone dot image or reproduction of a line image.

In the prior art, a special developer solution called a lith developer is used for this purpose.

The lith developer contains hydroquinone as a sole developing agent. In order that the infectious development of hydroquinone is not disturbed, a sulfite salt is used as a preservative in the form of an adduct with formaldehyde so as to minimize the concentration of free sulfite ions. Thus the lith developer has the serious drawback that it is quite liable to aerial oxidation and cannot be shelf stored over 3 days.

One known method for obtaining superhigh contrast photographic characteristics using a stable developer is by using hydrazine derivatives as described in U.S. Pat. Nos. 4,224,401, 4,168,977, 4,166,742, 4,311,781, 4,272,606, 4,221,857, 4,243,739, etc. This method can provide photographic characteristics with superhigh contrast and high sensitivity and allows a high concentration of a sulfite salt to be added to the developer so that the stability of the developer against air oxidation is outstandingly improved over the lith developer.

The hydrazine derivatives exert their effect of rendering the contrast super high and increasing sensitivity only when the developer is in a high pH range. However, such a high pH level undesirably leads to a reduced effective life of the developer.

For the high pH developers, a phosphate salt is well known as a buffer and widely used because of low cost.

On the other hand, a fixer solution containing a water-soluble aluminum salt as a hardener is used in order to mitigate the load of drying treated photosensitive materials in processing with an automatic developing machine or processor, particularly often used in rapid processing. Although the phosphate salt has a high buffering ability at a high pH range as mentioned above, a hardening fixer solution cannot be used in combination with it. When a phosphate is used in combination with a fixer containing an aluminum salt as a hardener, there is formed a precipitate of aluminum phosphate to leave white deposits on the associated roller, which are transferred to the treated photosensitive material. Although a variety of buffering agents have been tested for high pH developers, no inexpensive substitute for phosphate salts has been discovered. Thus, the high pH developer is used at the sacrifice of ease of drying in processing with an autoprocessor.

As the above problem indicates, the use of a high pH developer has several troubles due to the maintenance of pH at such a high level. If there is available a developer which has an extended effective life in addition to high performance and high stability and which can be used at a sufficient pH range to dispense with a phosphate salt, such a contrast enhancing developer would be very useful.

U.S. Pat. No. 4,269,929 discloses a method of supplying a contrast promoting amount of an amine during development of the photographic silver halide material containing hydrazine derivatives. However, the amines are undesirable because they often produce an unpleasant odor. The amines can reduce the pH of the developer only to a small extent.

There is a need for developing a method capable of establishing a high pH level during development without sacrificing the shelf storage and stability of a developer.

Japanese Patent Application Kokai No. 56-89736 discloses a method in which a silver halide photosensitive material having a hydrazine compound and a dihydroxybenzene developing agent incorporated therein is treated with an alkaline activator.

However, a highly alkaline activator treating solution having a pH of at least 11.5, particularly 12 to 14 is required in order to obtain a sufficiently high contrast image. The alkaline activator treating solution having such a high pH value tends to reduce its pH by absorbing carbon dioxide in air during storage or treatment. High pH solutions are dangerous to human bodies and the environment.

SUMMARY OF THE INVENTION

A primary object of the present invention is to provide an image forming method which can improve the aging stability and rapid treatment of a developer solution at a reduced cost while maintaining contrast and sensitivity enhancing effects.

Another object of the present invention is to provide an image forming method which can improve the aging stability of a processing solution, is safe to manipulate, easy and quick to carry out, and produce a super high contrast negative image.

The above-mentioned objects are accomplished by the present invention which provides a method for forming an image, comprising the steps of:

imagewise exposing a photographic silver halide light-sensitive material comprising at least a silver halide and a contrast enhancing agent, and treating the exposed material in the presence of a substantially water-insoluble metal compound and a complexing compound capable of water-mediated complexing reaction with the metal ion of the substantially water-insoluble metal compound.

DETAILED DESCRIPTION OF THE INVENTION

According to the image forming method of the present invention, a light-sensitive material is imagewise exposed and then treated in the presence of a substantially water-insoluble metal compound and a compound capable of complexing reaction with the metal ion of the substantially water-insoluble metal compound in water medium (to be referred to as complexing compound, hereinafter).

The treatment used herein means in an illustrative sense to treat a light-sensitive material with a developer solution or to treat a developing agent-containing light-sensitive material with an aqueous activator solution. In the specification, both developer and activator solutions are often referred to as treating solution.

In the embodiment wherein a light-sensitive material is treated with a developer solution, it is the reaction between the two compounds defined above that increases the pH of the reaction system usually in the form of a silver halide emulsion layer during development. Thus, the developer solution itself may have a relatively low pH, generally 7 to 11, preferably 7 to 10.5.

The developer solution can have a relatively low pH prior to development and hence, improved aging stability.

Such a relatively low pH developer solution eliminates the use of a high pH-buffering agent, for example, phosphate and can thus be used in combination with a hardener-containing fixer solution, reducing a drying load. It also enables combined treatment with a variety of existing plate making photosensitive materials using a hardener-containing fixer solution. A cost reduction is expected because existing less expensive chemicals such as carbonates can be used as a buffer agent for the developer solution.

In the embodiment wherein a light-sensitive material is treated with an aqueous activator solution, the solution generally has a pH 7 to 11, preferably pH 8 to 10.5. The reaction between the two compounds defined above increases the pH of the reaction system usually in the form of a silver halide emulsion layer during treatment. The pH of the reaction system reaches about 11.5 to 13.

The activator solution can have a relatively low pH prior to treatment and hence, improved aging stability.

The substantially water-insoluble metal compounds used in the present invention are those compounds having a solubility in water at 20° C. of up to 0.5 as expressed in grams of the compound dissolved in 100 grams of water, including carbonate, phosphate, silicate, borate, and aluminate salts, hydroxides, oxides, and complex salts of these compounds such as basic salts. The preferred metal compounds are represented by the general formula:

$$T_mX_n$$

wherein T is a transition metal such as Zn, Ni, Al, Co, Fe, Mn, etc. or an alkaline earth metal such as Ca, Ba, Mg, etc.; X is a member that can form in water a counter ion to M as will be described in conjunction with the nitrogenous heterocyclic compound and exhibits alkaline nature, for example, a carbonate ion, phosphate ion, silicate ion, borate ion, aluminate ion, hydroxy ion, and oxygen atom; and m and n are such integers as to establish equilibrium betweeen the valences of T and X.

Some preferred, non-limiting examples of the substantially water-insoluble metal compounds include calcium carbonate, barium carbonate, magnesium carbonate, zinc carbonate, strontium carbonate, magnesium calcium carbonate $CaMg(CO_3)2$; magnesium oxide, zinc oxide, tin oxide, cobalt oxide; zinc hydroxide, aluminum hydroxide, magnesium hydroxide, calcium hydroxide, antimony hydroxide, tin hydroxide, iron hydroxide, bismuth hydroxide, manganese hydroxide; calcium phosphate, magnesium phosphate; magnesium borate; calcium silicate, magnesium silicate; zinc aluminate, calcium aluminate; basic zinc carbonate $2ZnCO_3.3Zn(OH)_2.H_2O$, basic magnesium carbonate $3MgCO_3.Mg(OH)_2.3H_2O$, basic nickel carbonate $NiC03.2Ni(OH)2$, basic bismuth carbonate $Bi_2(CO_3)O_2.H_2O$, basic cobalt carbonate $2CoCO_3.3Co(OH)_2$, and aluminum magnesium oxide. Most preferred among them are uncolored compounds.

The complexing compounds used in the present invention are capable of forming a complex salt with the metal component in ionic form of the substantially water-insoluble basic metal compounds, the complex exhibiting a stability constant of at least 1 as expressed in logK. These complexing compounds are detailed in A.E. Martell & R.M. Smith, "Critical Stability Constants", Vols. 1–5, Plenum Press, inter alia.

Illustrative examples of the complexing compounds include salts of aminocarboxylic acid analogs, iminodiacetic acid analogs, anilinecarboxylic acid analogs, pyridinecarboxylic acid analogs, aminophosphoric acid analogs, carboxylic acid analogs (including mono-, di-, tri-, and tetracarboxylic acids, and their derivatives having a substituent such as phosphono, hydroxy, oxo, ester, amide, alkoxy, mercapto, alkylthio, and phosphino), hydroxamic acid analogs, polyacrylic acid analogs, and polyphosphoric acid analogs with alkali metals, guanidines, amidines, and quaternary ammonium.

Preferred, non-limiting examples of the complexing compounds are salts of picolinic acid, 2,6-pyridinedicarboxylic acid, 2,5-pyridinedicarboxylic acid, 4-dimetthylaminopyridine-2,6-dicarboxylic acid, quinoline-2-carboxylic acid, 2-pyridylacetic acid, oxalic acid, citric acid, tartaric acid, isocitric acid, malic acid, gluconic acid, EDTA (ethylenediaminetetraacetic acid), NTA (nitrilo-triacetic acid), CDTA (trans-1,2-cyclohexanediamine-N,N,N',N'-tetraacetic acid), hexametaphosphoric acid, tripolyphosphoric acid, tetraphosphoric acid, polyacrylic acid, and acids of the following chemical formulae:

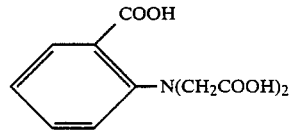

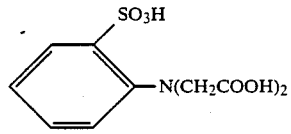

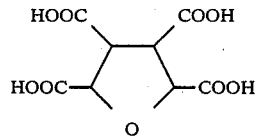

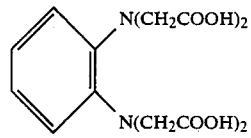

$HOOCCH_2OCH_2CH_2OCH_2COOH$ $HOOCCH_2OCH_2COOH$

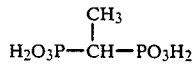

with alkali metals, guanidines, amidines, and quaternary ammonium.

Preferred among others are those aromatic heterocyclic compounds having at least one —COOM and containing one nitrogen atom in their ring wherein M is selected from ions of alkali metals, guanidines, amidines, and quaternary ammonium. The ring contained therein may be a single ring or a fused ring such as a pyridine ring and a quinoline ring. The position at which —COOM is attached to the ring is most preferably the α-position of the ring relative to the N atom.

Also included in the preferred compounds are those represented by the following formula:

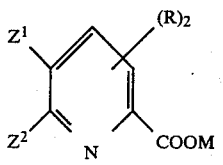

(I)

In the above formula, R represents an electron donative radical selected from the group consisting of a hydrogen atom, aryl radical, halogen atom, alkoxy radical, —COOM, hydroxycarbonyl radical, amino and substituted amino radical, and alkyl radical. The two R's may be the same or different. $Z^1$ and $Z^2$ are as defined for R and may be combined together to form a ring fused to the pyridine ring. M is as defined above.

Examples of the most preferred combinations of the substantially water-insoluble metal compounds and the complexing compounds are illustrated below. In the following formulae, M⊖ represents an alkali metal ion, substituted or unsubstituted guanidinium ion, amidinium ion, or quaternary ammonium ion.

| Substantially insoluble compound | Complexing compound |
|---|---|
| Calcium carbonate | 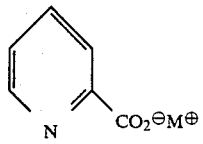 |
| Basic zinc carbonate | 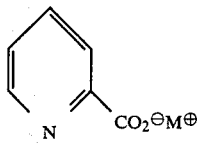 |
| Basic magnesium carbonate | 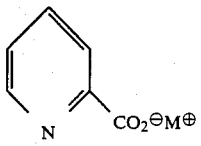 |
| Zinc oxide | 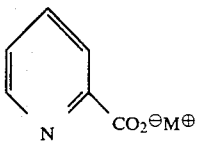 |

-continued

| Substantially insoluble compound | Complexing compound |
|---|---|
| Zinc hydroxide | 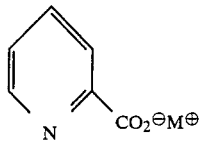 |
| Aluminum hydroxide | 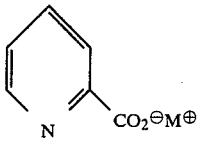 |
| Basic zinc carbonate | 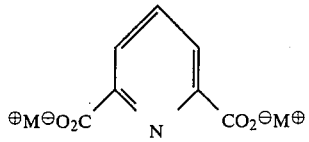 |
| Basic magnesium carbonate | 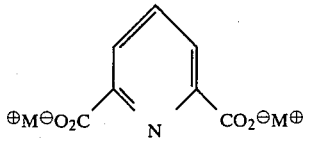 |
| Calcium carbonate | 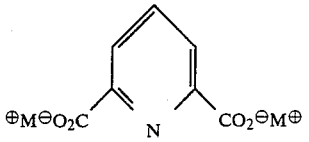 |
| Zinc oxide | 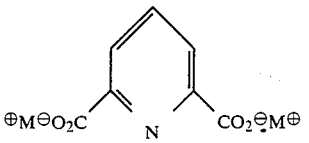 |
| Zinc hydroxide | 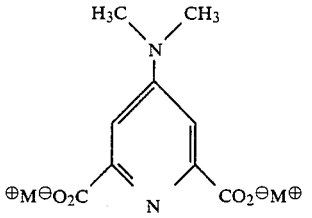 |
| Tin hydroxide | 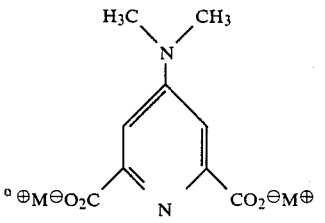 |
| Calcium carbonate | 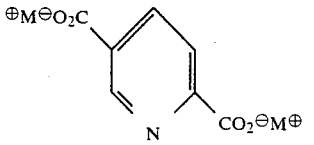 |

-continued

| Substantially insoluble compound | Complexing compound |
|---|---|
| Basic zinc carbonate | 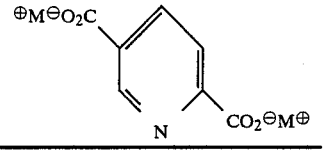 |

These combinations may be used alone or in admixture of two or more.

The mechanism of increasing the pH of the reaction system according to the present invention will be described by referring to one exemplary combination of guanidine picolinate with zinc hydroxide. Their reaction may be represented by the following scheme:

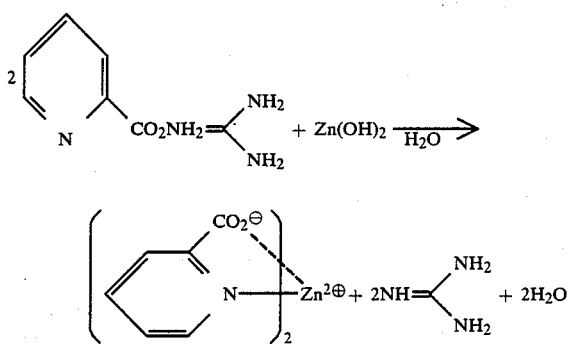

When guanidine picolinate and zinc hydroxide are mediated by water in the processing solution, picolinate ions make a complexing reaction with zinc ions and the reaction proceeds according to the above-illustrated scheme, presenting a high alkaline level.

The progress of this reaction is attributable to the stability of the resulting complexes. Picolinate ions ($L^{\oplus}$) and zinc ions $M^{63}$) form complexes ML, $ML_2$, and $ML_3$ having a very high stability constant as shown below, which well accounts for the progress of the reaction.

| | ML | $ML_2$ | $ML_3$ |
|---|---|---|---|
| logK | 5.30 | 9.62 | 12.92 |

It is preferable to incorporate the substantially water-insoluble metal compound into a photosensitive material and the complexing compound into a treating solution.

It is desirable to incorporate the substantially water-insoluble metal compound as a fine particulate dispersion which may be prepared by the methods described in Japanese Patent Application Kokai Nos. 59-174830 and 53-102733. In such dispersions, the compounds preferably have an average particle size of 50 μm or less, especially 5 μm or less. When the substantially water-insoluble metal compound is incorporated into a photosensitive material, it may be added to any layer on a support, preferably to an emulsion layer and/or a protective layer. The amount of the metal compound added to the photosensitive material depends on the type and particle size of the compound, complexing reaction rate, and other factors. Preferably, the metal compound is added in an amount of 0.05 to 5.0 g/m$^2$.

The amount of the metal compound added preferably ranges from 0.3 to 2 g/m$^2$ when a photosensitive material is treated with an aqueous activator solution.

The complexing compound is added to the treating solution in an amount of 5 to 50 g/1.

Now description is made on the embodiment of the image forming method of the present invention wherein an exposed photosensitive material is treated with a developer solution.

The developing agent used in the developer is not particularly limited although dihydroxybenzenes are preferably contained in view of high halftone quality, and combinations of dihydroxybenzenes with 1-phenyl-3-pyrazolidones or p-aminophenols are more preferable in view of developing ability.

Examples of the dihydroxybenzene developing agents include hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone, 2,5-dimethylhydroquinone, etc., with hydroquinone being preferred.

The developing agents of 1-phenyl-3-pyrazolidone and its derivatives include 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, 1-p-tolyl-4,4-dimethyl-3-pyrazolidone, etc. The developing agents of p-aminophenols include N-methyl-p-aminophenol, p-aminophenol, N-(β-hydroxyethyl)-p-aminophenol, N-(4-hydroxyphenyl)glycine, 2-methyl-p-aminophenol, p-benzylaminophenol, etc., with N-methyl-p-aminophenol being most preferred.

The developing agent is preferably used in the developer in an amount of 0.05 to 0.8 mol/liter. Where a dihydroxybenzene and a 1-phenyl-3-pyrazolidone or p-aminophenol are used in combination, the former and the latter are preferably used in amounts of 0.05 to 0.5 mol/liter and up to 0.06 mol/liter, respectively.

The developer used in the present invention may contain a preservative, typically sulfites such as sodium sulfite, potassium sulfite, lithium sulfite, and quaternary ammonium compounds. Specific examples are given in U.S. Patent No. 4,269,925 and Japanese Patent Application Kokai No. 60-218642.

The developer used in the present invention may have a pH of 7 to 11, preferably 7 to 10.5. An alkaline agent may be used for pH adjustment if necessary and examples thereof include usual water-soluble inorganic alkali metal salts such as sodium hydroxide, potassium hydroxide, and sodium carbonate.

In the practice of the present invention, the developer may be used in combination with a hardening/fixer solution so that a variety of plate-making photosensitive materials of the type using a hardening/fixer may be simultaneously treated. This is an essential requirement for plate making operation. Since plate making and block copying operations involve to combine a variety of photosensitive materials, the possibility of treatment under the same conditions is very important in the art.

The developer used in the the present invention can be used for an extended period of time because of its great advantage that the developing agent contained therein undergoes significantly reduced oxidation with time.

Other additives may be contained in the developer used in the present invention, including pH adjusting agents such as carbonates, borates, and sulfites; development inhibitors such as sodium bromide, potassium bromide, and potassium iodide; organic solvents such as ethylene glycol, diethylene glycol, and triethylene glycol; antifoggants or black pepper preventing agents, for example, mercapto compounds such as 1-phenyl-5-mercaptotetrazole, indazole compounds such as 5-nitroindazole, and benzotriazole compounds such as 5-methylbenzotriazole. The developer may optionally contain toning agents, surface active agents, defoaming agents, water softening agents, hardening agents, and the like.

The fixer solution used herein may be any of commonly used compositions. The fixing agents may include thiosulfates and thiocyanates as well as organic sulfur compounds known to be effective as fixing agents. The fixer may contain a hardening agent, for example, water-soluble aluminum salts such as aluminum sulfate and alum. The amount of water-soluble aluminum salts added generally ranges from 0 to 1.4 g of Al per liter. The fixing solution may further contain as an oxidizing agent a trivalent iron compound in the form of a complex with ethylenediamine tetraacetic acid.

The temperature of developing treatment is generally selected between 18° C. and 50° C., more preferably between 25° C. and 43° C.

The developing method according to the present invention is particularly suitable for rapid treatment with an auto-processor. The auto-processor may be any machine of the roller transfer type, belt transfer type and other types. The treating time may be brief. The developing method according to the present invention is fully effective when applied to a rapid treatment requiring a total treating time of 2 minutes or less, particularly 100 seconds or less, with the time allotted to development being 15 to 60 seconds.

The development treating method according to the present invention eliminates the necessity of complicated solution control or maintenance and is successful in providing consistent photographic characteristics of super contrast and high sensitivity simply by making up the developer in proportion to the treated area of photosensitive material.

Next description is made on the other embodiment of the image forming method of the present invention wherein an exposed photosensitive material is treated with an aqueous activator solution.

Such a treatment is usually made with an autoprocessor of the roller transfer type although a coating development system is also available because of a very short developing time.

It is also possible to impregnate a porous material with an activator according to the present invention, place the porous material and a photosensitive material in close contact, and apply pressure and/or heat to the assembly.

The aqueous activator solutions used herein may contain any ingredients (other than the developing agent) used in ordinary developers in addition to the complexing compound mentioned above. More particularly, the activator solutions may contain pH buffer agents, for example, carbonates such as sodium carbonate and potassium carbonate, phosphates such as sodium primary phosphate and potassium tertiary phosphate, and borates such as boric acid, sodium metaborate, and borax; development inhibitors, for example, borides, iodides, polyalkylene oxides; and antioxidants such as sodium sulfite and potassium metabisulfite. If desired, the activator solutions may further contain organic solvents such as diethylene glycol, triethylene glycol, diethanolamine, and triethanolamine; water softeners such as sodium tetrapolyphosphate, sodium hexametaphosphate, sodium nitrilotriacetate, ethylenediamine tetraacetic acid or its sodium salt; hardeners such as glutaraldehyde; viscosity builders such as carboxymethyl cellulose and hydroxyethyl cellulose; toning agents; surface active agents; and defoaming agents. If necessary, alkali metal hydroxides such as sodium hydroxide may also be contained.

A fixer solution of a commonly used composition may be used. The fixing agents may include thiosulfates and thiocyanates as well as organic sulfur compounds known to be effective as fixing agents. The fixer may contain a watersoluble aluminum salt as a hardening agent.

The treating temperature is preferably selected between 18° C. and 50° C. although it may range from below 18° C. to above 50° C.

Where the silver halide photosensitive material is treated with the aqueous activator solution, the material contains a dihydroxybenzene developing agent. The developing agent may be selected from those compounds previously listed for the developer although the preferred developing agent is hydroquinone.

The dihydroxybenzene developing agent may be contained in any layers in the photosensitive material, but preferably in at least one of emulsion layers and other hydrophilic colloid layers. The amount of the dihydroxybenzene developing agent added preferably ranges from 0.06 to 6.3 mols, more preferably from 0.1 to 2.0 mols per mol of silver.

Preferably in such a case, the photosensitive material may further contain a pyrazolidinone developing agent. Such a developing agent may be selected from 1-phenyl-3-pyrazolidone or its derivatives previously listed for the developer. The pyrazolidinone developing agent may be added at the same position as the dihydroxybenzene developing agent and the amount added preferably ranges from 0.006 to 0.6 mols, more preferably from 0.02 to 0.2 mols per mol of silver.

The silver halide photosensitive materials to which the image forming method of the present invention is applicable will be described.

The photosensitive materials according to the present invention may contain contrast enhancing agents, typically hydrazine derivatives. They are described in Research Disclosure, Item 23516, November 1983, page 346 and the literature cited therein, and U.S. Pat. Nos. 4,080,207, 4,269,929, 4,276,364, 4,278,748, 4,385,108, 4,459,347, 4,560,638, 4,478,928, British Patent No. 2,011,391B, Japanese Patent Application Kokai No. 60-179734.

Preferred examples of the hydrazine derivatives used herein are aryl hydrazides having a sulfinic acid residue attached to a hydrazo moiety as described in U.S. Pat. No. 4,478,928, and compounds of the general formula (II):

$$\text{II } R^4\text{—NHNH—G—}R^5$$

wherein $R^4$ is an aliphatic or aromatic group; $R^5$ is a hydrogen atom, substituted or unsubstituted alkyl group, substituted or unsubstituted aryl group, substituted or unsubstituted alkoxy group, or substituted or unsubstituted aryloxy group; G is a carbonyl group, sulfonyl group, sulfoxy group, phosphoryl group or N-substituted or unsubstituted iminomethylene group.

In general formula (II), the aliphatic groups represented $R^4$ are preferably those having 1 to 30 carbon atoms, especially straight chain, branched or cyclic alkyl groups having 1 to 20 carbon atoms.

The aromatic groups represented by $R^4$ are preferably single or double ring aryl groups or unsaturated heterocyclic group.

Particularly preferred $R^4$ groups are aryl groups. The aryl groups and unsaturated heterocyclic groups represented by $R^4$ may be substituted ones, and typical substituents are straight chain, branched or cyclic alkyl groups (preferably having 1 to 20 carbon atoms), aralkyl groups (preferably single or double ring aralkyl groups whose alkyl moiety has 1 to 3 carbon atoms), alkoxy groups (preferably having 1 to 20 carbon atoms), substituted amino groups (preferably amino groups substituted with an alkyl group having 1 to 20 carbon atoms), acylamino groups (preferably having 2 to 30 carbon atoms), and sulfonamide groups (preferably having 1 to 30 carbon atoms).

Preferred groups represented by $R^5$ are a hydrogen atom, methyl group, methoxy group, ethoxy group, substituted or unsubstituted phenyl group, especially hydrogen atom where G is a carbonyl group.

Preferred groups represented by $R^5$ are a methyl group, ethyl group, phenyl group, and 4-methylphenyl group, especially methyl group where G is a sulfonyl group.

Preferred groups represented by $R^5$ are a methoxy group, ethoxy group, butoxy group, and phenoxy group, especially phenoxy group where G is a phosphoryl group.

Preferred groups represented by $R^5$ are a cyanobenzyl group and methylthiobenzyl group where G is a sulfoxy group, and a methyl group, ethyl group, and substituted or unsubstituted phenyl group where G is an N-substituted or unsubstituted iminomethylene group.

The $R^4$ or $R^5$ groups may be those having incorporated therein a ballast group as commonly used in immobile photographic additives such as couplers. The ballast groups are groups having at least 8 carbon atoms which are relatively inert to photographic properties.

The $R^4$ or $R^5$ groups may be those having incorporated therein a group capable of enhancing adsorption to the silver halide grain surface. These adsorptive groups are thiourea groups, heterocyclic thioamide groups, mercapto heterocyclic groups, and triazole groups as disclosed in U.S. Pat. No. 4,385,108.

The most preferred group represented by G in general formula (II) is a carbonyl group.

Examples of the compounds of general formula (II) are illustrated below. It is to be noted that the present invention is not limited to the illustrated ones.

II-1

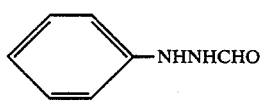

II-2

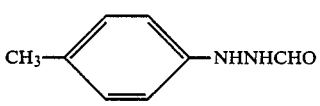

II-3

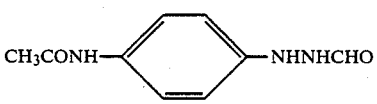

II-4

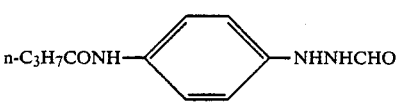

II-5

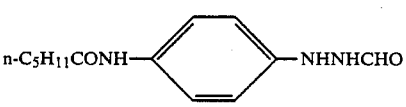

II-6

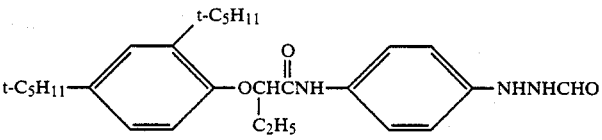

II-7

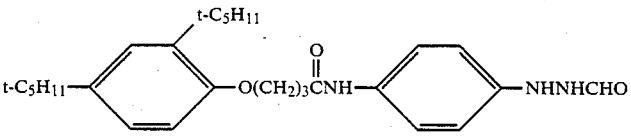

-continued

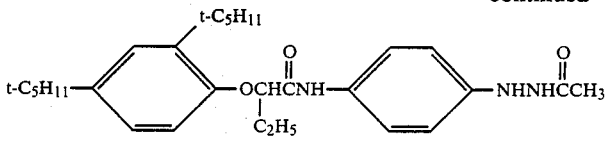

II-8

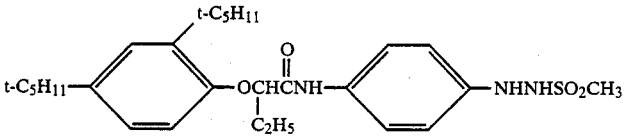

II-9

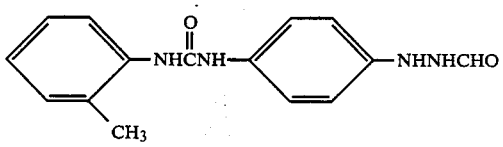

II-10

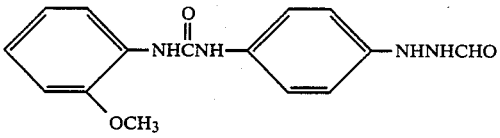

II-11

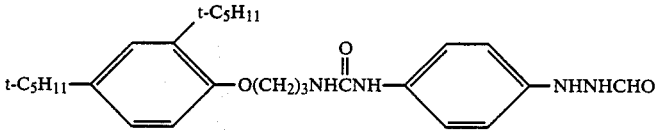

II-12

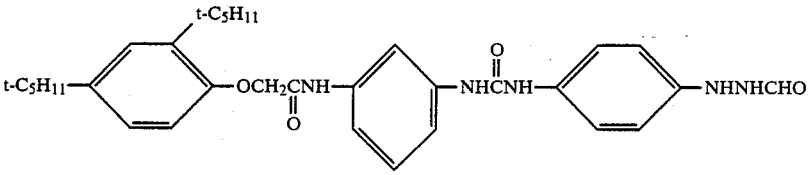

II-13

These compounds may be synthesized by the methods described in Japanese Patent Application Kokai No. 53-20921, 53-20922, 53-66732, and 53-20318.

The compounds of general formula (II) are preferably added in an amount of $1\times10^{-6}$ to $5\times10^{-2}$ mol, more preferably $1\times10^{-5}$ to $2\times10^{-2}$ mol per mol of silver halide.

The compound may be added to a photographic emulsion at any desired time from the initiation of chemical ripening to application or coating, preferably at the end of chemical ripening.

The silver halide emulsion used in the practice of the present invention is not particularly limited in halide composition and may have any composition comprising silver chloride, silver chlorobromide, silver iodobromide, silver bromide, silver iodobromochloride or the like.

The silver halide grains in the photographic emulsion used herein may have a relatively wide grain size distribution although a relatively narrow grain size distribution is preferred. Most preferred are those emulsions wherein 90% of the silver halide grains as expressed in the weight or number of the grains have a size falling within ±40% of the average grain size. These emulsions are generally referred to as monodispersed emulsions.

The silver halide grains used herein are preferably fine grains having a grain size of at most 0.7 μm, more preferably at most 0.4 μm.

The silver halide grains in the photographic emulsion may have either a regular crystal shape such as a cubic and octahedral shape or an irregular crystal shape such as a spherical or plate shape, or a mixture of these shapes.

The silver halide grains may be of a uniform phase or different phases between the core and the outer layer.

It is also possible to use a mixture of at least two silver halide emulsions which are separately prepared.

In the silver halide emulsion used herein, a salt such as a cadmium salt, sulfite salt, lead salt, thalium salt, iridium salt or complex salt thereof, rhodium salt or complex salt thereof may coexist during formation or physical ripening of silver halide grains.

The silver halide emulsion may be a so-called primitive emulsion which has not been post-ripened or chemically sensitized although the emulsion may be chemically sensitized.

Chemical sensitization may rely on such a method as described in H. Frieser, Die Grundlagen der photographischen Prozesse mit Silver Halogeniden, Akademisch Verlagsgesselschaft, 1968. More particularly, there may be used the sulfur sensitization method using active gelatin or sulfur-containing compounds capable of reacting with silver (for example, thiosulfates, thioureas, mercapto compounds, and rhodanines), the reducing sensitization method using reducing compounds (for example, stannous salts, amines, hydrazine derivatives, formamidine sulfinic acid, and silane compounds), the noble metal sensitization method using noble metal compounds (for example, gold compounds and complex salts of metals of Group VIII in Periodic Table such as platinum, iridium, and palladium), alone or in combination.

The photographic emulsion used herein may be spectrally sensitized with methine dyes or other suitable dyes. The dyes used herein include cyanine dyes, merocyanine dyes, complex cyanine dyes, complex merocyanine dyes, holopolar cyanine dyes, hemicyanine dyes, styryl dyes, and hemioxonol dyes. Particularly useful dyes are cyanine dyes, merocyanine dyes, and complex merocyanine dyes. These dyes may be used in combination so as to accomplish supersensitization.

A high contrast promoter such as amine compounds and quaternary onium salts may be added to a photographic emulsion layer or a layer adjacent thereto according to the present invention. Specific examples of the promoters are described in U.S. Pat. No. 4269929.

The photographic emulsion used herein may contain various compounds for the purpose of preventing fogging or stabilizing photographic performance during preparation, storage, and photographic treatment of a photosensitive material. There may be added a variety of compounds known as antifoggants or stabilizers, including azoles, for example, benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (such as 1-phenyl-5-mercaptotetrazole); mercaptopyrimidines; mercaptotriazines; thioketo compounds (such as oxazolinethione); azaindenes, for example, triazaindenes, tetraazaindenes (such as 4-hydroxy substituted (1,3,3a,7)-tetraazaindenes), and pentaazaindenes; benzenethiosulfonic acid, benzenesulfonic acid, benzenesulfonic acid amide, etc. Particularly preferred among them are benzotriazoles such as 5-methylbenzotriazole. These compounds may also be contained in the treating solutions.

The photographic light-sensitive material used herein may contain an inorganic or organic hardener in a photographic emulsion layer or another hydrophilic colloid layer. There may be used chromium salts (such as chromium alum and chromium acetate), aldehydes (such as formaldehyde, glyoxale, and glutaraldehyde), N-methylol compounds (such as dimethylol urea and methylol dimethylhydantoin), dioxane derivatives (such as 2,3-dihydroxydioxane), active vinyl compounds (such as 1,3,5-triacryloyl-hexahydro-a-triazine and 1,3-vinylsulfonyl-2-propanol), active halogen compounds (such as 2,4-dichloro-6-hydroxy-a-triazine), and mucohalogenic acids (such as mucochloric acid and mucophenoxychloric acid), alone or in admixture thereof.

The photosensitive material used herein may contain various surface-active agents in a photographic emulsion layer or another hydrophilic colloid layer thereof for various purposes of coating aids, antistatic, lubrication, emulsifying dispersion, adherence prevention and photographic properties improvement (for example, development acceleration, contrast enhancement, and sensitization).

The particularly preferred surface active agents used herein are polyalkylene oxides having a molecular weight of at least 600 as described in Japanese Patent Publication No. 58-9412.

When the surface-active agents are used as antistatic agents, fluorine-containing surface-active agents are particularly preferred as disclosed in U.S. Pat. No. 4,201,586 and Japanese Patent Application Kokai No. 60-80849 and 59-74554.

The photosensitive material used herein may contain a matte agent in a photographic emulsion layer or another hydrophilic colloid layer thereof for the purpose of preventing adherence, examples of the matte agent being silica, magnesium oxide, and polymethylmethacryalte.

The photographic emulsion used herein may contain a dispersion of a water-insoluble or substantially water-insoluble synthetic polymer for the purpose of improving dimensional stability and other purposes. The polymers used for such purposes are homopolymers and copolymers of alkyl (meth)acrylate, alkoxy acryl (meth-)acrylate, and glycidyl (meth)acrylate, and polymers of such monomer units combined with acrylic acid or methacrylic acid.

The photographic light-sensitive material of the present invention may preferably contain a compound having an acid group in a silver halide emulsion layer or another layer thereof. The acid group-bearing compounds include organic acids such as salicylic acid, acetic acid and ascorbic acid and polymers and copolymers having an acid monomer such as acrylic acid, maleic acid and phthalic acid as recurring units. For these compounds, reference is made to Japanese Patent Application Kokai No. 61-223834, 61-228437, 62-25745 and 62-55642. Particularly preferred low and high molecular compounds are ascorbic acid and a water-dispersible latex of a copolymer comprising an acid monomer such as acrylic acid and a crosslinkable monomer having at least two unsaturated group such as divinylbenzene.

Gelatin is advantageously used as a binder or protective colloid in the photosensitive material according to the present invention although hydrophilic synthetic polymers may also be used. The gelatin may be selected from lime-treated gelatin, acid-treated gelatin, and gelatin derivatives. Specific examples are given in Research Disclosure, Vol. 176, RD-17643 (December 1978).

The photographic silver halide light-sensitive material used herein may contain any desired one of various additives, for example, desensitizers, coating aids, antistatic agents, plasticizers, lubricants, development accelerators, oil, and dyes.

These and the above-mentioned additives may be selected from the specific examples described in Research Disclosure, Vol. 176, pages 22–31, RD-17643 (Dec. 1978).

In the photosensitive material used in the practice of the present invention, each of the emulsion and protective layers may consist of either a single ply or two or more plies. In the case of a multiple-ply layer, an intermediate ply may be interposed between the plies.

In the photographic light-sensitive material used herein, the photographic emulsion layer or other layer may be coated on one or both surfaces of a flexible support which is commonly used in photographic light-sensitive materials. Useful flexible supports are films of synthetic polymers such as cellulose acetate, cellulose acetate butyrate, polystyrene, and polyethylene terephthalate.

The present invention has a number of benefits. In the embodiment wherein an exposed photosensitive material is treated with a developer, the aging stability of the developer can be improved while maintaining the contrast enhancing and sensitivity increasing effects. Running performance is stabilized and the minimum daily necessary makeup can be reduced. The developer is stable partially because its deterioration by oxidation is reduced and its resistance to $CO_2$ gas is improved as compared with conventional high pH developers.

The method of the present invention eliminates the necessity of a pH buffer agent for maintaining high pH, allows a mild pH buffer agent of a low cost to be used, and reduces the amount of $Na_2SO_{03}$ added as a preservative, accomplishing a cost reduction.

In the embodiment wherein an exposed photosensitive material is treated with an aqueous activator solution, the solution has improved aging stability, handling is safe, treatment is easy, and a very high contrast negative image is obtained. As in the case of the developer, the activator solution is stable partially because there occurs no pH reduction due to absorption of $CO_2$ with time as observed with conventional high pH developers, that is, the $CO_2$ gas resistance is improved.

Examples of the present invention are given below by way of illustration and not by way of limitation.

EXAMPLE 1

An emulsion of 0.3 μm silver chlorobromide containing rhodium was prepared. Soluble salts are removed from the emulsion by a known method, and sodium thiosulfate and potassium chloroaurate were added to the emulsion for chemical ripening. The resulting emulsion had a composition of 70 mol% silver chloride and 30 mol% silver bromide and contained $5\times10^{-6}$ mol of rhodium per mol of silver. To the emulsion were added 1.0 gram/m$^2$ of $Zn(OH)_2$ as a substantially insoluble metal compound, $1\times10^{-3}$ mol/mol of silver of the hydrazine derivative identified as compound II-9, 3-ethyl-5-[2-(3-ethyl-2(3H)-thiazolinidene-ethylidene]rhodanine as a sensitizing dye, 5-methylbenzotriazole, 4-hydroxy-6-methyl-1,3,3a,7-tetraazaindene, polyethyl acrylate dispersion, and sodium 2-hydroxy-4,6-dichloro-1,3,5-triazine salt. The emulsion was then coated on a cellulose triacetate film so as to give 4 g/m$^2$ of silver. This photosensitive material is designated sample No. 101.

Photosensitive material sample No. 102 was prepared by repeating the procedure for sample No. 101 except that the substantially insoluble metal compound was omitted.

Photosensitive material sample No. 103 was prepared by repeating the procedure for sample No. 101 except that the substantially insoluble metal compound, $Zn(OH)_2$ was replaced by basic zinc carbonate.

Each of the photosensitive materials was exposed through a sensimetry exposure optical wedge using a 150-line magenta contact screen. They were developed in an autoprocessor FG660F (Fuji Photo Film Co., Ltd.) by first supplying a developer of the composition shown in Table 1 to examine the photographic performance of a fresh developer. After the solution was allowed to stand for 6 days, the machine was operated to examine the photographic performance in the same manner without replenishing.

Development was carried out at 34° C. for 30 seconds. The fixer solution used was a hardener-free fixer GF-1 (Fuji Photo Film Co., Ltd.).

The results are shown in Table 2.

TABLE 1

| Developer | A | B | C |
|---|---|---|---|
| Hydroquinone | 35.0 g | 35.0 g | 35.0 g |
| N-methyl-p-aminophenol ½ hydrogen sulfate | 0.8 g | 0.8 g | 0.8 g |
| Sodium hydroxide | 9.0 g | — | — |
| Potassium tertiary phosphate | 74.0 g | — | — |
| Sodium carbonate | — | 50.0 g | 45.0 g |
| Potassium sulfite | 90.0 g | 80.0 g | 80.0 g |
| Disodium EDTA | 1.0 g | 1.0 g | 1.0 g |
| 3-diethylamino-1-propanol | 15.0 g | 15.0 g | 15.0 g |
| 5-methylbenzotriazole | 0.5 g | 0.5 g | 0.5 g |
| Sodium bromide | 3.0 g | 3.0 g | 3.0 g |
| Sodium picolinate | — | 35.0 g | — |
| Guanidinium picolinate | — | — | 40.0 g |
| Water totaling to | 1 liter | 1 liter | 1 liter |
| pH | 11.80* | 10.2* | 10.5* |

*adjusted with KOH

TABLE 2

| Sample No. | Developer | Fresh solution Sensitivity | HTQ | BP | 6 day aged solution without replenishment Sensitivity | BP |
|---|---|---|---|---|---|---|
| 101* | A | 100 | 5 | 5 | 130 | 3 |
| 101 | B | 100 | 5 | 5 | 100 | 4 |
| 101 | C | 100 | 5 | 5 | 100 | 5 |
| 102* | A | 100 | 5 | 5 | 130 | 2 |
| 102* | B | 50 | 1 | 5 | 50 | 5 |
| 102* | C | 50 | 1 | 5 | 50 | 5 |
| 103* | A | 100 | 5 | 4 | 120 | 2 |
| 103 | B | 97 | 4 | 4 | 97 | 4 |
| 103 | C | 100 | 5 | 5 | 100 | 5 |

*outside the scope of the invention
HTQ: halftone quality
BP: black pepper

In Table 2, sensitivity is a relative value of the reverse of exposure providing a blackening density of 1.5 based on the value of 100 for fresh developer A. Halftone quality and black pepper were visually rated in five grades 1 to 5, with "5" being the best and "1" being the worst quality.

As a plate-making halftone original, halftone quality and black pepper ratings of "5" and "4" are practically acceptable, "3" is the lowest acceptable quality, and "2" and "1" are practically unacceptable.

It is evident from Table 2 that a combination of the compounds according to the present invention allows a developer of lower pH to be used, improving sensitivity variation and black pepper formation which are otherwise caused by deterioration of the developer by oxidation.

Since the fixer GF-1 was free of a hardener, the samples were insufficiently dried to a semi-dry state. When a hardening fixer which is the same as used in Example 2 described later was used, the samples were fully dried. However, the combination of this fixer with developer A caused white precipitates to deposit on a fixing roller, leaving stains on the roller surface. The combinations with developers B and C resulted in no deposit of white precipitates and hence, photographs having good surface properties.

EXAMPLE 2

Photosensitive material sample Nos. 101 and 103 used in Example 1 were treated with a developer of the following composition falling within the scope of the present invention using an auto-processor FG660F (Fuji Photo Film Co., Ltd.). The fixer used was a hardening fixer having the following composition.

| | |
|---|---|
| Developer | |
| Hydroquinone | 35.0 g |
| Sodium sulfite | 80.0 g |
| Disodium EDTA | 0.5 g |
| Potassium bromide | 3.8 g |
| n-butyldiethanol amine | 10.0 g |
| 5-methylbenzotriazole | 0.35 g |
| Guanidinium picolinate | 30.0 g |
| Sodium carbonate | 40.0 g |
| 1-phenyl-4-hydroxymethyl-3-pyrazolidone | 0.4 g |
| Water | |
| totaling to | 1 liter |
| pH | 10.2 |
| Hardening fixer | |
| Ammonium thiosulfate | 180 g |
| Sodium thiosulfate $5H_2O$ | 45 g |
| Sodium sulfate | 18 g |
| Nitrilotriacetic acid | 0.4 g |
| Tartaric acid | 4.0 g |
| Glacial acetic acid | 30.0 g |
| Aluminum sulfate | 8.0 g |
| Water totaling to | 1 liter |
| Ammonia adjusting pH to | 4.7 |

The photosensitive materials were treated over 3 weeks at a rate of 20 full size (50.8 cm×61.0 cm) sheets per day to find that the photographic properties were stable as they were maintained equal to those available with the fresh developer.

EXAMPLE 3

An emulsion of 0.3 μm silver iodobromide containing rhodium was prepared. Soluble salts are removed from the emulsion by a known method, and sodium thiosulfate and potassium chloroaurate were added to the emulsion for chemical ripening. The resulting emulsion had a composition of 1 mol% silver iodide and 99 mol% silver bromide and contained 5x10-6 mol of rhodium per mol of silver. To the emulsion were added 1.0 gram/m2 of Zn(OH)2 as a substantially insoluble metal compound, 1x10-3 mol/-mol of silver of the hydrazine derivative identified as compound II-7, 3-ethyl-5[2-(3-ethyl-2(3H)-thiazolinidene-ethylidene]rhodanine as sensitizing dye, 5-methylbenzotriazole, 4-hydroxy-6-methyll,3,3*a*, 7-tet-raazaindene, polyethy acrylate dispersion, sodium 2-hydroxy-4,6-dichloro-1,3,5-triazine salt, hydroquinone in aqueous 10% gelation solution, and 4-hydroxymethyl-4-methyl-1-phenyl-3-pyrazolidinone (simply abbreviated as pyrazolidinone). The emulsion was then coated on a cellulose triacetate film so as to give 4 g/m2 of silver. The amounts of hydroquinone and pyrazolidinone coated were 1.6 g/m2 and 0.4 g/m2, respectively. This photosensitive material is designated sample No. 301.

Photosensitive material sample No. 302 was prepared by repeating the procedure for sample No. 301 except that the substantially insoluble metal compound was omitted.

Photosensitive material sample No. 303 was prepared by repeating the procedure for sample No. 301 except that the substantially insoluble metal compound, Zn(OH)2 was replaced by basic zinc carbonate.

Photosensitive material sample No. 304 was prepared by repeating the procedure for sample No. 301 except that the substantially insoluble metal compound, Zn(OH)2 was replaced by calcium carbonate.

Each of the photosensitive materials was exposed through a sensimetry exposure optical wedge using a 150-line magenta contact screen. They were developed at 25° C. for 10 seconds with an aqueous activator solution (A), (B) or (C) of the composition shown below, stopped, fixed, washed, dried, and examined for photographic properties. Development was made at 25° C. for 10 seconds using an autoprocessor FG-360F (Fuji Photo Film Co., Ltd.). The fixer used was GF-1 (Fuji Photo Film Co., Ltd.).

| | |
|---|---|
| Activator Solution (A) | |
| Anhydrous sodium sulfite | 2.0 g |
| Potassium bromide | 5.0 g |
| Potassium carbonate | 40.0 g |
| Sodium hydroxide | 30.0 g |
| Water | |
| totaling to | 1 liter |
| pH | 13.0 |
| Activator Solution (B) | |
| Anhydrous sodium sulfite | 2.0 g |
| Potassium bromide | 5.0 g |
| Potassium carbonate | 40.0 g |
| Sodium picolinate | 35.0 g |
| Guanidinium picolinate | — |
| Water totaling to | 1 liter |
| pH adjusted with KOH to | 10.5 |
| Activator Solution (C) | |
| Anhydrous sodium sulfite | 2.0 g |
| Potassium bromide | 5.0 g |
| Potassium carbonate | 40.0 g |
| Sodium picolinate | — |
| Guanidinium picolinate | 40.0 g |
| Water totaling to | 1 liter |
| pH adjusted with KOH to | 11.0 |

To compare the stability of the treating solution in each run, the treating solution was allowed to remain in the auto-processor for 4 days and then development was carried out in the same manner as above to examine photographic properties. The results are shown in Table 3.

In Table 3, halftone quality (HTQ) was visually rated in five grades 1 to 5, with "5" being the best and "1" being the worst quality. As a halftone original for plate making, halftone quality ratings of "5" and "4" are practically acceptable, while "3", "2" and "1" are practically unsatisfactory.

Sensitivity (Sens) is a relative value based on the value of 100 for fresh solution.

Maximum density (Dmax) was measured using a Macbeth densitiometer.

TABLE 3

| Sample | Activator | Fresh solution | | | After 4 day aging | | |
|---|---|---|---|---|---|---|---|
| No. | solution | Sens. | HTQ | Dmax | Sens. | HTQ | Dmax |
| 301* | A | 100 | 5 | 5.7 | 70 | 3 | 4.0 |
| 301 | B | 100 | 5 | 5.4 | 100 | 4.5 | 5.3 |
| 301 | C | 100 | 5 | 5.5 | 100 | 5 | 5.4 |
| 302* | A | 100 | 5 | 5.5 | 85 | 3 | 4.2 |
| 303 | B | 100 | 4 | 5.0 | 97 | 4 | 4.9 |
| 303 | C | 100 | 5 | 5.3 | 100 | 5 | 5.1 |
| 304 | B | 100 | 4 | 5.2 | 95 | 4 | 5.0 |
| 304 | C | 100 | 5 | 5.1 | 100 | 5 | 5.0 |

*combination outside the scope of the invention

It is evident from Table 3 that aging of a conventional high pH type activator solution (A) in the auto-processor resulted in a marked pH reduction, inviting reductions in sensitivity, Dmax and halftone quality.

Because of their low pH, activator solutions (B) and (C), after aging, experienced little activity reduction and maintained their properties substantially unchanged from those of fresh solutions. These activator solutions were also improved in safety aspect because they were less slimy to handle and did not attack fibers when splashed on cloths.

I claim:

1. A method for forming an image, comprising the steps of:

(a) imagewise exposing a photographic silver halide light-sensitive material comprising at least a silver halide, a hydrazine derivative as a contrast enhancing agent, and a substantially water-insoluble metal compound, (b) developing the exposed material with a treating solution (i) containing a complexing compound capable of water-mediated complexing reaction with the metal ion of said substantially waterinsoluble metal compound, and (ii) being free of a phosphate buffer, and (c) treating the developed material with a fixer solution containing a water soluble aluminum salt as a hardening agent.

2. The image forming method of claim 1 wherein said treating solution is a developer solution.

3. The image forming method of claim 1 wherein said photographic silver halide light-sensitive material further comprises at least one member selected from dihydroxybenzenes as a developing agent and said treating solution is an aqueous activator solution at pH 7 to 11.

4. The image forming method of claim 1 wherein said substantially water-insoluble metal compound is selected from the group consisting of a carbonate salt, phosphate salt, silicate salt, borate salt, aluminate salt, hydroxide, oxide, and basic salt, provided that said metal compound has a solubility in water at 20° C. of 0.5 or less as expressed in grams of the compound dissolved in 100 grams of water.

5. The image forming method of claim 1 wherein said complexing compound is selected from aromatic heterocyclic compounds having at least one —COOM group and containing one nitrogen atom in the ring thereof wherein M is an alkali metal ion, substituted or unsubstituted guanidinium ion, amidinium ion, or quaternary ammonium ion.

6. The image forming method of claim 5 wherein the aromatic heterocyclic compound contains a pyridine or quinoline ring.

7. The image forming method of claim 5 wherein —COOM is attached to the ring at the α-position thereof relative to the N atom.

8. The image forming method of claim 1 wherein said complexing compound is selected from compounds having the general formula:

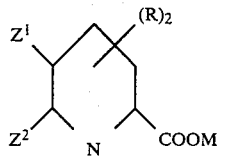

wherein R represents an electron donative substituent selected from the group consisting of hydrogen, an aryl group, a halogen atom, an alkoxy group, a —COOM group, a hydroxycarbonyl group, an amino or substituted amino group, and an alkyl group, the two R's may be the same or different, $Z^1$ and $Z^2$ are as defined for R and may be combined together to form a ring fused to the pyridine ring, and M is an alkali metal ion, substituted or unsubstituted guanidinium ion, amidinium ion, or quaternary ammonium ion.

9. The image forming method of claim 1 wherein said substantially water-insoluble metal compound is present in an amount of 0.05 to 5.0 g/m$^2$ based on the light-sensitive material.

10. The image forming method of claim 2 wherein the developer solution contains the complexing compound.

11. The image forming method of claim 2 wherein said complexing compound is present in an amount of 5 to 50 grams per liter of the developer solution.

12. The image forming method of claim 3 wherein said complexing compound is present, in an amount of 5 to 50 grams per liter of the activator solution.

13. The image forming method of claim 2 wherein the developer solution contains at least one dihydroxybenzene as a developing agent.

14. The image forming method of claim 2 wherein the developer solution contains at least one member selected from dihydroxybenzenes and at least one member selected from 1-phenyl-3-pyrazolidones and p-aminophenols as developing agents.

15. The image forming method of claim 2 wherein the developer solution contains at least one dihydroxybenzene at a concentration of 0.05 to 0.8 mol/1.

16. The image forming method of claim 2 wherein the developer solution contains at least one member selected from dihydroxybenzenes at a concentration of 0.05 to 0.8 mol/1 and at least one member selected from 1-phenyl-3pyrazolidones and p-aminophenols at a concentration of up to 0.06 mol/1.

17. The image forming method of claim 3 wherein the photographic silver halide light-sensitive material contains at least one member selected from dihydroxybenzenes and at least one member selected from pyrazolidinones as developing agents.

18. The image forming method of claim 3 wherein the photographic silver halide light-sensitive material contains at least one member selected from dihydroxybenzenes as a developing agent in an amount of 0.06 to 6.3 mols per mol of silver.

19. The image forming method of claim 3 wherein the photographic silver halide light-sensitive material contains as developing agents at least one member selected from dihydroxybenzenes in an amount of 0.06 to 6.3 mols per mol of silver and at least one member selected from pyrazolidinones in an amount of 0.006 to 0.6 mols per mol of silver.

20. The image forming method of claim 1 wherein the hydrazine derivative is an aryl hydrazide having a sulfinic acid residue attached to the hydrazo moiety.

21. The image forming method of claim 1 wherein the hydrazine derivative is a compound having the formula:

$$R^4—NHNH—G—R^5$$

wherein $R^4$ is an aliphatic or aromatic group, $R^5$ is a hydrogen atom, substituted or unsubstituted alkyl group, substituted or unsubstituted aryl group, substituted or unsubstituted alkoxy group, or substituted or unsubstituted aryloxy group, and G is a carbonyl group, sulfonyl group, sulfoxy group, phosphoryl group, or N-substituted or unsubstituted iminomethylene group.

* * * * *

UNITED STATES PATENT AND TRADEMARK OFFICE

CERTIFICATE OF CORRECTION

PATENT NO. : 4,920,035

DATED : April 24, 1990

INVENTOR(S) : Katsumi Hayashi

It is certified that error appears in the above-identified patent and that said Letters Patent is hereby corrected as shown below:

Column 22, line 18, after "present" delete ",".

Signed and Sealed this

Tenth Day of September, 1991

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 4,920,035

DATED : April 24, 1990

INVENTOR(S) : Katsumi Hayashi

It is certified that error appears in the above-identified patent and that said Letters Patent is hereby corrected as shown below:

Column 21, line 60, replace the present general formula for the following:

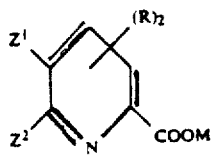

Signed and Sealed this

Twenty-sixth Day of November, 1991

*Attest:*

HARRY F. MANBECK, JR.

*Attesting Officer*

*Commissioner of Patents and Trademarks*